US006427574B1

(12) United States Patent
Callahan

(10) Patent No.: US 6,427,574 B1
(45) Date of Patent: Aug. 6, 2002

(54) SUBMARINE HORIZONTAL LAUNCH TACTOM CAPSULE

(75) Inventor: Jeffrey C. Callahan, West Greenwich, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/832,111

(22) Filed: Apr. 11, 2001

(51) Int. Cl.[7] ..... F41F 3/00
(52) U.S. Cl. ..... 89/1.81; 89/1.817
(58) Field of Search ..... 89/1.81, 1.817, 89/1.819

(56) References Cited

U.S. PATENT DOCUMENTS 3,194,119 A * 7/1965 Robert et al. ..... 89/1.7
3,499,364 A * 3/1970 D'ooge ..... 89/1.81
3,815,469 A * 6/1974 Schubert et al. ..... 89/1.701
4,185,538 A * 1/1980 Barakauskas ..... 89/1.81
4,301,708 A * 11/1981 Mussey ..... 89/1.81
4,498,368 A * 2/1985 Doane ..... 89/1.817
4,586,421 A * 5/1986 Hickey et al. ..... 89/1.81
4,643,072 A * 2/1987 Hillebrechtt ..... 89/1.81
4,986,188 A * 1/1991 Denis et al. ..... 102/493
5,062,345 A * 11/1991 Tegel et al. ..... 89/1.817
5,239,909 A * 8/1993 Bell et al. ..... 89/1.807
5,398,588 A * 3/1995 Peck ..... 89/1.806
6,123,005 A * 9/2000 Kuchta et al. ..... 89/1.817
6,311,604 B1 * 11/2001 Foris et al. ..... 89/1.817

* cited by examiner

*Primary Examiner*—Michael J. Carone
*Assistant Examiner*—M. Thomson
(74) *Attorney, Agent, or Firm*—Michael J. McGowan; Michael F. Oglo; Prithvi C. Lall

(57) ABSTRACT

A Submarine Horizontal Launch TACTOM Capsule (SHLTC) provides the capability for launching a Tactical Tomahawk (TACTOM) cruise missile from a horizontal torpedo tube on a submarine. The SHLTC completely encapsulates the TACTOM missile in the torpedo tube and is ejected from the torpedo tube with the TACTOM missile during launch. The SHLTC contains the TACTOM missile in a closure assembly to protect the TACTOM missile from damage. Following safe exit from the submarine, thrust from the rocket motor allows the TACTOM missile to break through a forward tearing shell of the SHLTC. The TACTOM missile and SHLTC completely de-couple and the SHLTC safely sinks away from the submarine and missile. The TACTOM missile continues up to broach the surface and transition to cruise mode.

12 Claims, 2 Drawing Sheets

SUBMARINE HORIZONTAL LAUNCH TACTOM CAPSULE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to a means for launching a missile from an undersea craft. More particularly, this invention relates to a capsule that provides the capability for reliably launching a Tomahawk cruise missile from the torpedo tube of a submarine.

(2) Description of the Prior Art

Currently, an operational cruise missile (Tomahawk Block III) is capable of being launched from a torpedo tube of a submarine is retained in a slotted capsule. The slotted capsule for this missile, referred to as the submarine torpedo tube launched (TTL) cruise missile, provides protection for the missile during loading, handling, and shipping evolutions. The slotted capsule exposes the missile to the flow of water from the system that ejects the missile from the torpedo tube. The capsule remains in the torpedo tube during and after launch of the missile, and consequently, the missile is exposed to damaging environments during exit from the torpedo tube and as it transitions through ambient water to near vertical orientation and ignition of a rocket motor on the missile.

The cruise missile known as the Tactical Tomahawk (TACTOM) is the next generation of the Tomahawk Cruise missile. Currently, TACTOM is being developed for vertical launch systems (VLS) for surface ships and Capsule Launch Systems (CLS) for submarines, only. The submarine CLS launch system protects the TACTOM from operational environments by completely encapsulating the missile. CLS TACTOM is ejected from the submarine/capsule via a gas generator, and capsule seals protect the TACTOM from ejection pressures. Modifications of current requirements and design of TACTOM have been excluded by an operational requirements document that would allow compatibility with environments for launch of TACTOM in torpedo tubes of current and future submarines. The TACTOM program is currently ongoing, with a critical design review (CDR) having been completed. It has been estimated by the design agent for TACTOM that the costs associated with changing the design/requirements following the CDR stage of the TACTOM program would be unacceptable given today's budget constraints. These changes would also cause significant delays in meeting the date when TACTOM is introduced in the Fleet.

Thus, in accordance with this inventive concept, a need has been recognized in the state of the art for an ejectable encapsulating structure, or capsule to launch missiles from underwater tubes including horizontally orientated torpedo tubes within current design, development and production schedules for TACTOM.

SUMMARY OF THE INVENTION

The first object of the invention is to provide the capability of launching Tactical Tomahawk (TACTOM) cruise missiles from horizontal torpedo tubes of submarines.

Another object is to provide launch environment protection to a TACTOM missile during pre-launch and launch stages in a horizontal torpedo tube and during ejection from the torpedo tube.

Another object is to provide a Submarine Horizontal Launch TACTOM Capsule (SHLTC) completely encapsulating a TACTOM missile during pre-launch and launch stages in a horizontal torpedo tube and during ejection from the torpedo tube to protect the TACTOM missile from damage.

Another object is to provide a SHLTC completely encapsulating a TACTOM missile to assure an intact and operational TACTOM missile as its rocket motor ignites at a safe separation distance from the submarine at depths of the torpedo tube.

Another object of the invention is to provide a SHLTC to launch missiles from horizontal torpedo tubes without affecting the current design, development and production schedules of the TACTOM.

Another object of the invention is to completely de-couple the TACTOM and SHLTC from each other as a rocket motor ignites to allow the SHLTC to sink away from the submarine and the TACTOM to continue towards the surface, broach the surface of the water and successfully transition to cruise.

These and other objects of the invention will become more readily apparent from the ensuing specification when taken in conjunction with the appended claims.

Accordingly, the present invention is a submarine horizontal launch TACTOM capsule including an aft closure assembly, capsule closure assembly, and forward closure assembly to encapsulate a TACTOM cruise missile during pre-launch and launch and provide the capability of launching a TACTOM cruise missile from torpedo tubes of submarines. The aft closure includes a back plate having components for pressurization vent control (PVC), the capsule barrel assembly includes longitudinal strips, and the forward closure assembly has a tearing shell to protect the TACTOM missile from harsh environmental abuses, such as torpedo tube flooding, hydraulic (water) impulses created during ejection of the TACTOM missile from a torpedo tube, damage caused by impact with surfaces and the mouth of the torpedo tube, damage causes by ambient shocks, equalization pressures inside the torpedo tube and the capsule, etc. Protection of the TACTOM missile from these abuses must be provided for by the SHLTC since the missile was not designed to be subjected to such abuses and survive.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
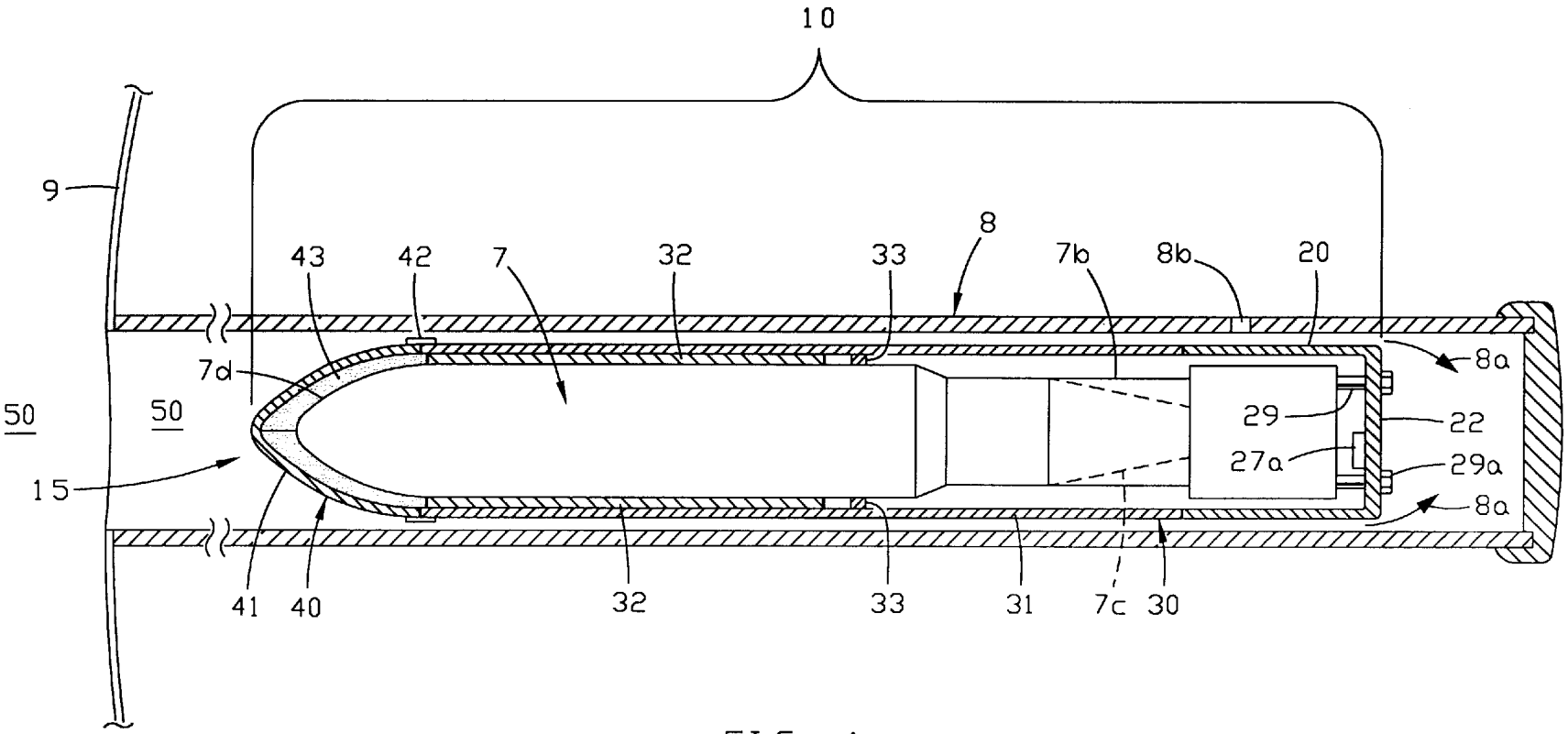
FIG. 1 is a cross-sectional schematic view of the Submarine Horizontal Launch TACTOM capsule (SHLTC) of this invention encapsulating a Tactical Tomahawk (TACTOM) cruise missile in the torpedo tube of a submarine to assure safe launching therefrom.

Referring to FIG. 1 of the drawings, a TACTOM missile 7 is shown in a submarine horizontal launch TACTOM capsule (SHLTC) 10 prior to being launched from horizontally oriented torpedo tube 8 of submarine 9. SHLTC 10 protects TACTOM missile 7 throughout its launch sequence in torpedo tube 8 and part of the launch sequence in ambient water 50.

SHLTC 10 and TACTOM 7 are ejected from torpedo tube 8 and submarine 9 as a combined unit, a SHLTC All-Up-Round (AUR) hereinafter referred to as SHLTC AUR 15. SHLTC AUR 15 is ejected from torpedo tube 8 by impulses 8*a* of pressurized water fed through port 8*b* of torpedo tube 8 from submarine 9. The outer diameter of SHLTC 10 of SHLTC AUR 15 is sized to permit sliding axial displacement of SHLTC AUR 15 in torpedo tube 8 by impulses 8*a* of pressurized water to a position where it has been ejected outside of submarine 9. Then, after the ejected SHLTC AUR 1s has continued to travel, or glide away from submarine 9 to what is known as a safe separation distance, rocket motor 7*a*, adjacent to shroud 7*c* and connected to tapered tail cone 7*c*, is ignited. After ignition, burning propulsion gases from rocket motor 7*a*propel TACTOM missile 7 from SHTLC 10, to and through the surface of ambient water 50, and on towards a target.

SHLTC 10 has three major assemblies sized to contain TACTOM missile 7. These assemblies, including an aft closure assembly 20, a capsule barrel assembly 30, and a forward closure assembly 40, completely encapsulate TACTOM missile 7 during the ejection sequence. Consequently, SHLTC 10 is able to protect TACTOM missile 7 from harsh environmental abuses, such as torpedo tube flooding, hydraulic (water) impulses Ba created during ejection of TACTOM missile 7 from tube 8, damage caused by impact with surfaces and the mouth of torpedo tube 8, damage caused by ambient shocks, equalization pressures inside tube 8 and SHLTC 10, etc. Protection of TACTOM missile 7 from these abuses must be provided for by SHLTC 10 as the missile was not designed to be subjected to such abuses and survive.

Figure 2:
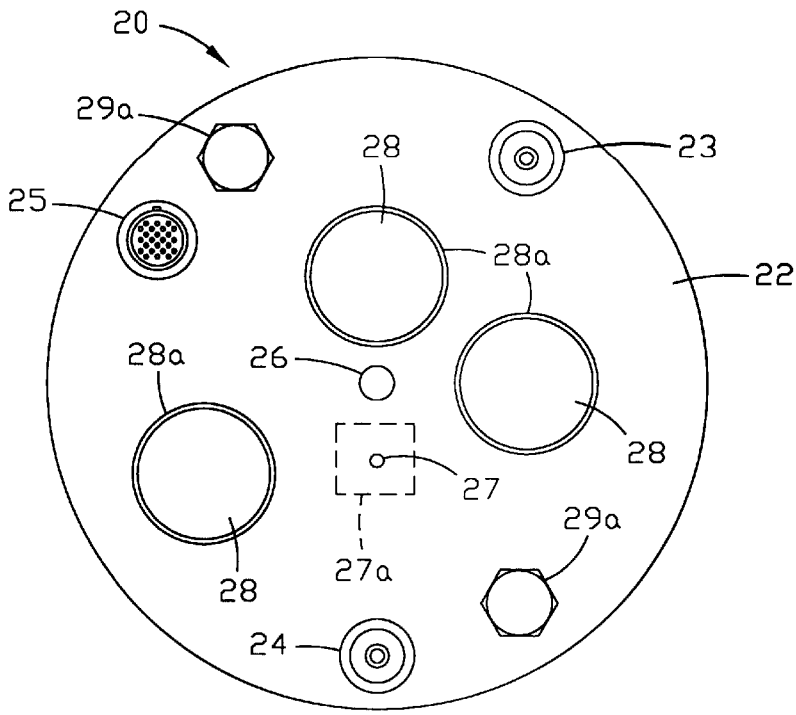
FIG. 2 is a schematic view of a back plate portion of an aft closure assembly showing components that provide some of the features of this invention.

Referring also to FIG. 2, aft closure assembly 20 can be made of metal and includes a back plate portion 22 that houses all of the components for the pressurization vent control (PVC) system to allow internal pressurization of SHLTC 10 and TACTOM missile 7 prior to and during launch. This internal pressurization prevents leakage of water 50 into SHLTC 10 and TACTOM 7 during pre-launch and launch phases of TACTOM missile 7 while underwater, following SHLTC 10 separation. Appropriate amounts of pressurized gas may be fed to the interior of SHLTC 10 via pneumatic connector fitting 23 in back plate 22 that is connected via an umbilical hose (not shown) to a remotely located source of pressurized gas (not shown) to maintain an overpressure within SHLTC 10 as compared to the pressure in torpedo tube 8 and ambient water 50. A pressure relief valve 24 extends through back plate 22 to vent inadvertent overpressures from SHLTC 10 and TACTOM 7. Such overpressures might be created, for example, as submarine 9 ascends and approaches the surface at rates faster than recommended rates, or from a PVC system malfunction.

Back plate 22 is built substantially enough to bear the load of displacing SHLTC AUR 15 from torpedo tube 8 by impulses 8*a* of water, and includes electrical connector 25 for interfacing with appropriate umbilical harnesses of electrical power and control leads (not shown) to start rocket motor 7*a* and/or initiate and possibly modify the operational program for TACTOM missile 7. In a preferred embodiment, load button 26 is included to allow loading of SHLTC AUR 15 into torpedo tube 8.

A pressure inlet 27 extending through back plate 22 is coupled to a differential pressure transducer 27*a* mounted on the inner wall of back plate 22. Pressure transducer 27*a* provides signals through electrical connector 25 that are representative of differential internal pressures between SHLTC AUR 15 and torpedo tube ambient water 50. These internal pressures may be monitored in submarine 9 and automatically or manually compensated for via pneumatic connector fitting 23 and pressure relief valve 24.

A plurality of disks 28 is provided in back plate 22 that rupture to exhaust, or vent amounts of propulsion gases from rocket motor 7*a* during its ignition. Rupture discs 28 cover ports 28*a* total about 50 square inches in area so as to adequately vent propulsion gasses when discs 28 are blown free of back plate 22 by built up pressure from propulsion gases. As a result, the build up of pressure from propulsion gases is reduced so that overpressure and possible damage of TACTOM missile 7 are prevented before it is powered out of SHLTC 10.

Separation bolts 29 are connected to back plate 22 via bolt heads 29*a*. Separation bolts 29 extend to and are connected to motor 7*a* of TACTOM missile 7 to releasably secure it in SHLTC 10. When TACTOM missile 7 is ejected from torpedo tube 8 and then becomes launched from SHLTC 10 as rocket motor 7*a* is initiated a safe distance outside of submarine 9, the thrust provided by burning propulsion gases from rocket motor 7*a* parts separation bolts 29 to free, or release TACTOM missile 7 from SHLTC 10. Capsule barrel assembly 30 includes a composite barrel 31 made, for example, from an approximately 0.280 inch thick layer of fiberglass/epoxy resin composite material that is suitably connected in a sealed relationship to aft closure assembly 20. A plurality of internal slide strips 32 made from a low friction material is provided in the inside of barrel 31 and extend longitudinally in barrel 30 in a spaced apart relationship with each other. Strips 32 lie adjacent to TACTOM missile 7 to assist in smooth decoupling and departure of TACTOM missile 7 from SHLTC 10 during ignition of rocket motor 7*a*. The outer diameter of barrel 31 of SHLTC 10 is sized to permit sliding axial displacement of SHLTC AUR 15 in torpedo tube 8 by impulses 8*a* of pressurized water to a position where it has been ejected outside of submarine 9. The inner separations of slide strips 32 on opposite inner sides of barrel 31 are such as to permit sliding axial displacement of TACTOM missile 7 within barrel 31 of SHLTC 10 by the thrust provided by propulsion gases from rocket motor 7*a* to a position outside of SHLTC 10. Use of this composite material in barrel 31 provides cost effective flexibility in design since material and manufacturing costs associated with composite barrel 31 are significantly cheaper than a metallic barrel (stainless, aluminum, etc.) with virtually no increase in maintenance requirements. In addition, a weight savings of approximately 500 lbs results from using composite materials for capsule barrel assembly 30. This savings in weight may allow for placement of additional ballast in the aft portion of barrel 31 and/or aft closure assembly 20. This placement can produce a desirable distribution of mass for optimal dynamic characteristics during underwater launch of SHLTC AUR 15 as rocket motor 7*a* ignites. Annular seal 33 can be located around the inside of barrel 31 to prevent blow-by of propulsion gases from burning rocket motor 7*a*.

Barrel 31 of capsule barrel assembly 30 might be made from stainless steel if other design constraints prevent utilization of composite materials. In either case capsule barrel assembly will be designed accordingly to provide sufficient structural integrity to withstand high impact shock environments while stowed in torpedo rooms, such as aboard SSN 688, SEAWOLF and VIRGINIA submarines to ensure that high safety requirements are met.

Forward closure assembly 40 has a conical shell portion 41 connected in a sealed relationship to capsule barrel assembly 30 via a rubber reinforced ring portion 42 to seal the interior of SHLTC 10 and TACTOM missile 7 from the ambient water 50. Forward closure assembly 40 additionally has an interior portion 43 made from polyurethane molded to contiguously conform to the inside surface of conical shell portion 41 and the outside surface of the nose 7*d* of TACTOM missile 7 and fill the space between shell portion 41 and nose 7*d*.

Figure 3:
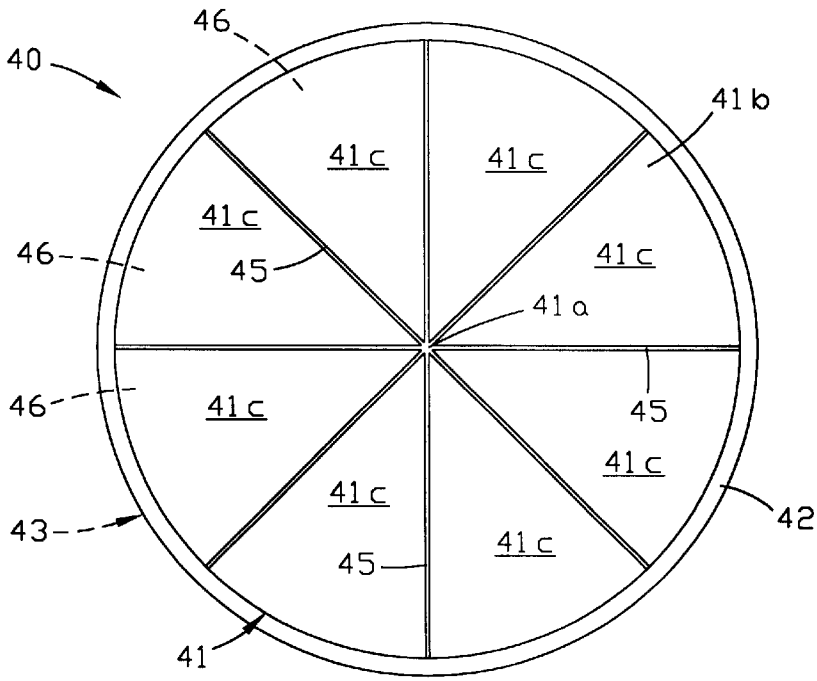
FIG. 3 is a schematic front view of the non-flexible metallic multi-leaf barrier of the forward closure assembly that will allow for uninhibited egress of the TACTOM missile from the SHLTC following ignition of the rocket motor.

Referring also to FIG. 3, conical shell portion 41 of forward closure assembly 40 can be fabricated from a sheet of rigid aluminum having a thickness of about 0.063 inches, for example. Optionally, a corrosion resistant coating can be provided on the exterior surface of conical shell portion 41. The non-flexible attributes of rigid conical shell portion 41 will eliminate bootstrapping environments that could arise, such as during pressurization of a TOMAHAWK (Block III) in an unvented torpedo tube 8. (Pressure increases caused by flexible diaphragm expansion in a closed and flooded tube 8 during launch of a TOMAHAWK (Block III) can overpressure the Block III missile and rupture its flexible diaphragm prematurely.)

Eight grooves 45 are cut into rigid conical shell portion 41 through its apex 41*a* to its trailing region 41*b* adjacent to ring portion 42 and provide paths of least resistance for tearing under pressure into triangular sections 41*c*. Interior portion 43 of forward closure assembly 40 is partitioned into wedge-shaped sections 46 with the separations between adjacent sections being located in line with and under grooves 45. Conical shell portion 41 and ring portion 42 of forward closure assembly 40 withstand differential pressures caused by higher pressures (overpressures) inside of SHLTC 10 in the range of about 5 psi and higher pressures (overpressures) outside of SHLTC 10 in the range of about 100 psi.

Grooves 45 are about 0.03 inches deep to define the interconnected non-flexible metallic multi-leaf barrier of eight triangular sections 41*c*. Grooves 45 are provided in conical shell portion 41 to rupture and tear along their lengths into triangular sections 41*c* as pressure builds up to levels that are in excess of 5 psi inside SHLTC 10 from TACTOM missile 7 forward movement following rocket motor 7*a* ignition. In addition to the rupturing and tearing along the lengths of grooves 45, the TACTOM missile 7 egress peels eight triangular sections 41*c* outward and back from nose 7*d* of TACTOM missile 7 to allow uninhibited egress and exit of TACTOM missile 7 from SHLTC 10 by the thrust created by propulsion gases coming from burning rocket motor 7*a*. This uninhibited egress and exit from SHLTC 10 by TACTOM missile 7 occurs outside of torpedo tube 8 at a safe separation distance from submarine 9.

As mentioned above, SHLTC 10 is the mechanism to eject TACTOM missile 7 from torpedo tube 8 and launch it in water 50. SHLTC 10 and TACTOM missile 7 are launched from torpedo tube 8 as a combined unit, SHLTC All-Up-Round (AUR) 15. SHLTC AUR 15 slideably fits within torpedo tube 8 so that it may be ejected from torpedo tube 8 by impulses 8*a* of pressurized water fed to it from submarine 9. No latches are needed to restrain SHLTC AUR 15 in torpedo tube 8, since both SHLTC 10 and TACTOM missile 7 are ejected from tube 8 at launch. SHLTC AUR 15 has approximately 600 lbs of negative buoyancy in water 50 and after it is safely ejected from tube 8 of submarine 9, forward closure assembly 40 and nose 7*d* of TACTOM missile 7 pitch upwards in water 50 due to the relationship of the center of buoyancy to the center of gravity of SHLTC AUR 15.

Following the ejection of SHLTC AUR 15 from torpedo tube 8, SHLTC AUR 15 travels a safe separation distance away from the hull of submarine 9. Then, at the safe separation distance from submarine 9, rocket motor 7*a* is ignited within SHLTC 10 at predetermined pitch angle/axial velocity conditions. SHLTC 10 houses pressurization vent control (PVC) components (as described previously) that are required for horizontal launch from torpedo tube 8 but were eliminated in the CLS TACTOM program. At ignition, thrust from rocket motor 7*a* pulls apart separation bolts 29 to release TACTOM missile 7 from aft closure assembly 20 and TACTOM missile 7 is propelled from SHLTC 10 to its designated target. SHLTC 10 then sinks safely clear of submarine 9. Thus, SHLTC 10 encapsulates TACTOM missile 7 to overcome the design limitations of TACTOM missile 7 and allow horizontal launch of missile 7 without requiring changes in its current baseline design.

SHLTC 10 of this invention is a cost effective way to launch TACTOM missiles 7, and other missiles from conventional torpedo tubes on submarines. SHLTC 10 can additionally be used in other launch scenarios, for example, in vertical or other orientations from different launch structures other than torpedo tubes. The complete encapsulation provided for by SHLTC 10 may help prevent aging and deterioration of components of the missile contained in it so that long-term reliability is enhanced. Thus, SHLTC 10 of this invention has flexibility in its design and applications to improve readiness for prolonged operations in a variety of different applications. SHLTC 10 in accordance with this invention gives tacticians and military personnel new and reliable options on land as well as on and below the surface of the water.

SHLTC 10 provides a way to launch TACTOM missile 7 from a torpedo tube without affecting current TACTOM design, development, and fleet introduction timeliness. SHLTC 10 completely encapsulates TACTOM missile 7 during pre-launch and launch operations in the torpedo tube, and will be ejected from the torpedo tube with TACTOM missile 7. This procedure differs significantly from existing TTL Tomahawk missile launches where the slotted capsule remains in the torpedo tube and the missile is susceptible to damage from the damaging environments associated with launching such missiles from torpedo tubes. Following safe exit from the hull of a submarine and parameters for ignition of the rocket motor, TACTOM missile 7 is ejected from SHLTC 10 via its rocket motor at depths where torpedo tubes of a submarine are located.

The disclosed components and their arrangements as disclosed herein all contribute to the novel features of this invention. SHLTC 10 of this invention provides a reliable and cost-effective means to improve the capabilities of the Fleet. Therefore, SHLTC 10 as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An apparatus for encapsulating a missile comprising:

a forward closure assembly having a rigid conical shell provided with grooves extending from its apex to a trailing region to separate said conical shell into triangular sections;

a capsule barrel assembly having a barrel connected to said forward closure assembly in a sealed relationship and internal, spaced-apart, longitudinally extending slide strips in its interior to lie adjacent to the missile and permitting axial sliding displacement of said missile therein; and an aft closure assembly connected to said capsule barrel assembly in a sealed relationship, said aft closure assembly having a cylindrically-shaped shell portion connected to a back plate portion, said back plate portion being provided with a plurality of rupture discs disposed in ports to blow out by propulsion gases from ignition of a rocket motor on said missile.

2. The apparatus of claim device of claim 1 wherein said back plate portion comprises:

a pneumatic fitting to feed pressurized gas therethrough to selectively pressurize said interior and said missile therein; and a pressure relief valve to selectively vent pressurized gas from said interior, said pneumatic fitting and said pressure release valve provide for internal pressurization to prevent leakage of water in said aft closure assembly, said capsule barrel assembly, said forward closure assembly, and said missile during pre-launch and launch phases of said missile while underwater.

3. The apparatus of claim 2 wherein said barrel has an outer diameter sized to permit sliding axial displacement thereof in a torpedo tube of a submarine as impulses of pressurized water impact said back plate portion of said aft closure assembly to eject said apparatus from said tube.

4. The apparatus of claim 3 wherein said base plate portion of said aft closure assembly includes an electrical connector to interface with umbilical harnesses of electrical power and control leads.

5. The apparatus of claim 4 wherein said material of said conical shell portion tears along said grooves as gas pressure from said rocket motor moves said missile toward said conical shell within said apparatus.

6. The apparatus of claim 5 wherein said material of said conical shell portion tears from an apex to a trailing region to allow said triangular sections to fold out of the way of said missile during said axial sliding displacement of said missile caused by said propulsion gases from said rocket motor.

7. The apparatus of claim 6 wherein said forward closure assembly includes an interior portion of molded material contiguously conforming to an inside surface of said conical shell portion and an outside surface of a nose of said missile to fill a space between said conical shell portion and said nose of said missile.

8. The apparatus of claim 7 wherein said interior portion of molded material is partitioned into wedge-shaped sections with individual separations between adjacent wedge-shaped sections disposed in line with and under individual ones of said grooves.

9. The apparatus of claim 8 wherein said wedge-shaped sections separate from one another by thrust created by said propulsion gases coming from said rocket motor and are released from said forward closure assembly to allow uninhibited egress and exit of said missile from said apparatus.

10. The apparatus of claim device of claim 9 wherein said aft closure portion is provided with separation bolts connected between said back plate portion and said rocket motor of said missile to releasably secure said missile thereto.

11. The apparatus of claim 10 wherein said separation bolts are parted by thrust provided by said propulsion gases from said rocket motor to release said missile from said encapsulating apparatus after said missile and encapsulating apparatus are ejected from said torpedo tube and said rocket motor is initiated a safe distance outside of said submarine.

12. The apparatus of claim 11 wherein said back portion of said aft closure assembly is provided with a differential pressure transducer on its inner wall to provide signals through said electrical connector representative of differential pressures between the inside of said capsule barrel assembly and ambient seawater.

* * * * *